US006634219B2

(12) United States Patent
Ito

(10) Patent No.: US 6,634,219 B2
(45) Date of Patent: Oct. 21, 2003

(54) ABNORMALITY TESTING APPARATUS FOR ENGINE SYSTEM

(75) Inventor: Tokiji Ito, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 108 days.

(21) Appl. No.: 09/871,900

(22) Filed: Jun. 4, 2001

(65) Prior Publication Data

US 2002/0007669 A1 Jan. 24, 2002

(30) Foreign Application Priority Data

Jun. 21, 2000 (JP) ..... 2000-186042

(51) Int. Cl.[7] ..... G01M 15/00; G01M 19/00
(52) U.S. Cl. ..... 73/116; 73/118.1
(58) Field of Search ..... 73/116, 118.1, 73/117.2, 118.2; 123/90.15, 90.16, 571

(56) References Cited

U.S. PATENT DOCUMENTS 4,122,667 A * 10/1978 Hosaka et al. ..... 60/39.091
5,559,706 A * 9/1996 Fujita ..... 701/114
5,626,108 A * 5/1997 Kato et al. ..... 123/90.15
5,675,080 A * 10/1997 Wada ..... 73/118.1
5,715,779 A * 2/1998 Kato et al. ..... 123/90.15

FOREIGN PATENT DOCUMENTS

| | | |
|---|---|---|
| JP | 1-142230 A | 6/1989 |
| JP | 7-36727 A | 2/1995 |
| JP | 11-107860 A | 4/1999 |
| JP | 11-148420 A | 6/1999 |
| JP | 11-257145 A | 9/1999 |

* cited by examiner

*Primary Examiner*—Edward Lefkowitz
*Assistant Examiner*—Takisha S Miller
(74) *Attorney, Agent, or Firm*—Oliff & Berridge, PLC

(57) ABSTRACT

An abnormality testing apparatus that accurately tests an abnormality at an early stage is disclosed. The apparatus includes means for manipulating a variable. The variable manipulating means computes the variable based on the state of the engine and manipulates the computed variable according to the state of the engine. The state includes a state in which the engine is not running. The apparatus performs at least one of the abnormality test and judgment whether a test condition is satisfied according to the variable.

22 Claims, 3 Drawing Sheets

ABNORMALITY TESTING APPARATUS FOR ENGINE SYSTEM

BACKGROUND OF THE INVENTION

The present invention relates to an abnormality testing apparatus for engine system, and more particularly, to an abnormality testing apparatus that tests an abnormality of an engine system based on historical data of the running state of a vehicle engine.

A typical engine system has an abnormality testing apparatus for detecting an abnormality of the system or for identifying a malfunctioning part. To improve the accuracy of tests, a typical testing apparatuses determines an abnormality based on historical data of the running state of the corresponding engine.

Japanese Unexamined Patent Publication No. 11-148420 discloses an abnormality testing apparatus. The apparatus determines an abnormality of a thermostat, which controls the flow rate of coolant, based on historical data of the engine. Specifically, the apparatus has a warming-up counter for estimating the temperature of coolant based on historical data of the running state of an engine. The apparatus determines whether there is an abnormality in a thermostat based on the counter value of the warming-up counter, which will be referred to as warming-up counter value. If the coolant temperature is less than a referential level when a predetermined period has elapsed after the engine was started and the warming-up counter value is equal to or greater than a predetermined value, the apparatus determines that there is an abnormality in the thermostat. The warming-up counter value corresponds to a predicted coolant temperature, which is computed based on the actual state of the engine on the supposition that the thermostat is operating normally. Since the warming-up counter value is used for determining an abnormality, an abnormality is accurately determined.

If the detected temperature does not smoothly increase, the valve of the thermostat may be stuck at the open position. That is, even if the engine was started from a cold state, coolant may be circulating between the radiator and a coolant passage in the engine. The manner in which the coolant temperature increases is significantly affected by the actual running state of the engine. Thus, determining an abnormality of the thermostat based only on the coolant temperature after the predetermined period may result in an erroneous determination. Such erroneous determination is prevented by determining an abnormality based on whether the warming-up counter value is equal to or greater than the predetermined value. When it is determined that there is an abnormality, a malfunction indicator lamp (MIL) in the passenger compartment is lit for notifying the passengers of the abnormality.

However, the warming-up counter value is cleared when the engine is stopped, or when the ignition switch is turned off, even if a test is not completed. Therefore, the computation of the predicted coolant temperature, which is computed when the engine is restarted, must be started over again. This causes the following disadvantages.

When the engine is temporarily stopped soon after being started from a cold state and is restarted after a short period, the coolant is still warm from the preceding running. Therefore, an abnormality may not be determined through a test. Even if an abnormality is detected, it takes a relatively long time to determine the abnormality.

In an engine system that performs so-called economy running mode, an engine is automatically stopped and restarted when the ignition switch is on. When the engine is stopped during economy running mode, the warming-up counter is not manipulated. Also, during economy running mode, each running time and each stopping time of the engine can be significantly short, which pronounces the above disadvantages.

SUMMARY OF THE INVENTION

Accordingly, it is an objective of the present invention to provide an abnormality testing apparatus for vehicle that accurately tests an abnormality at an early state.

To achieve the foregoing and other objectives and in accordance with the purpose of the present invention, an apparatus for testing an abnormality of an engine system is provided. The apparatus includes means for manipulating a variable. The variable manipulating means computes a variable that relates to the engine system based on the state of an engine and manipulates the variable in accordance with the state of the engine. The apparatus performs at least one of the abnormality test and judgment whether a test condition is satisfied according to the variable. The variable manipulating means manipulates the variable in the state of the engine. The state includes a state in which the engine is not running.

The present invention may be embodied in another apparatus for testing an abnormality of an engine system. The apparatus includes means for manipulating a variable. The variable manipulating means computes a variable that relates to the engine system based on the state of an engine and manipulates the variable in accordance with the state of the engine. The apparatus performs at least one of the abnormality test and judgment whether a test condition is satisfied according to the variable. When the engine is started, the variable manipulating means manipulates the variable based on the value of the variable that was manipulated when the engine was stopped immediately before and on historical data that represents the state of the engine. The state includes a state in which the engine is not running.

The present invention may also be embodied in a method for testing an abnormality of an engine system. The method includes computing a variable that relates to the engine system based on the state of an engine, manipulating the variable in accordance with the state of the engine, wherein the state includes a state in which the engine is not running, and performing at least one of the abnormality test and judgment whether a test condition is satisfied according to the variable.

Further, the embodiment may be embodied in another method for testing an abnormality of an engine system. The method includes computing a variable that relates to the engine system based on the state of an engine, manipulating the variable when the engine is started based on the value of the variable that was manipulated when the engine was stopped immediately before and on historical data that represents the state of the engine, wherein the state includes a state in which the engine is not running, and performing at least one of the abnormality test and judgment whether a test condition is satisfied according to the variable.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
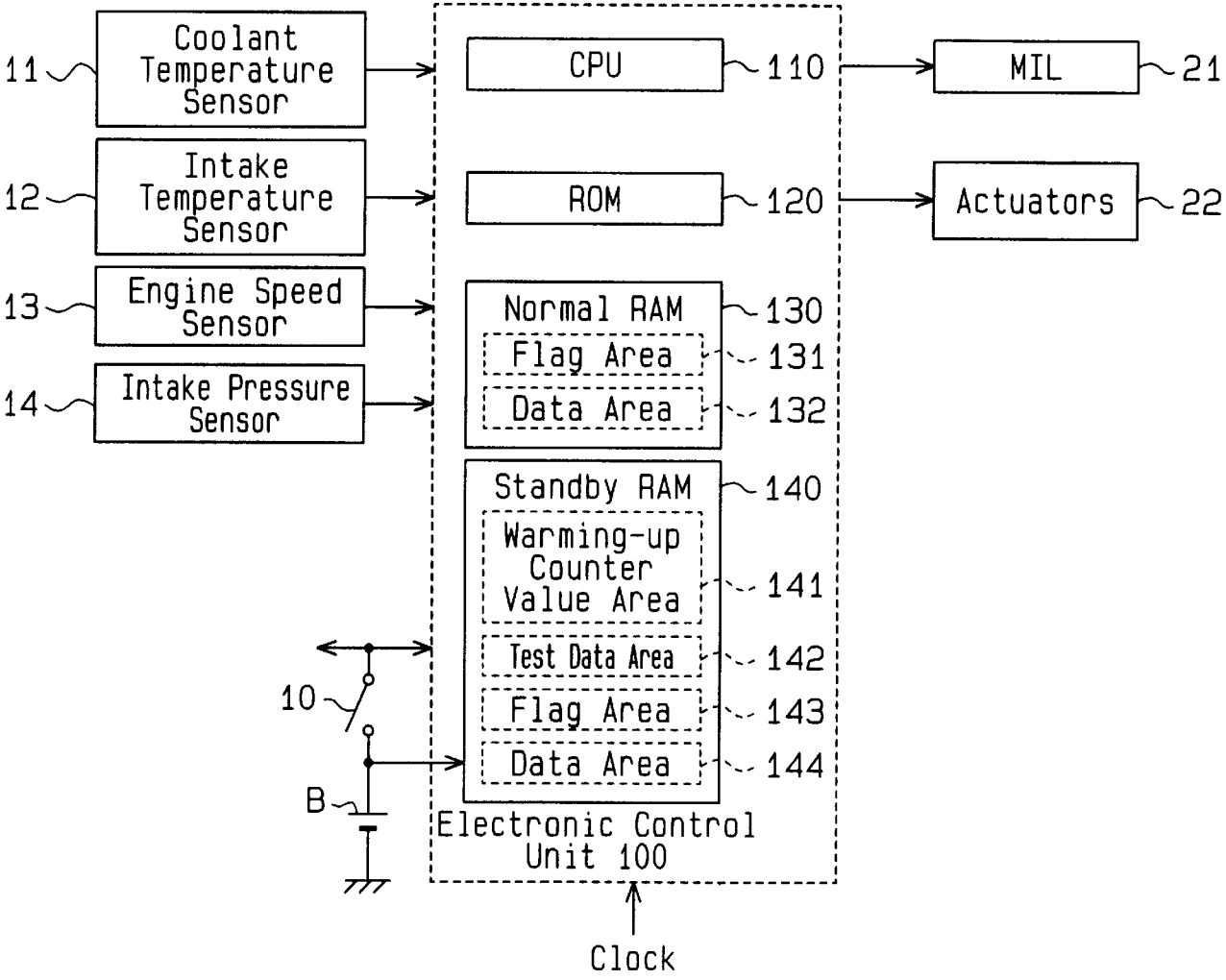
FIG. 1 is a schematic block diagram illustrating an abnormality testing apparatus according to a first embodiment of the present invention.

In the drawings, like numerals are used for like elements throughout.

An abnormality testing apparatus of an engine system 90 according to a first embodiment of the present invention will now be described with reference to FIGS. 1 to 4. The abnormality testing apparatus determines an abnormality of a thermostat of the engine system 90.

As shown in FIG. 1, the engine system 90 includes a coolant temperature sensor 11 for detecting the temperature of coolant of an engine (not shown), an intake temperature sensor 12 for detecting the temperature of air that is drawn into the engine, an engine speed sensor 13 for detecting the speed of the engine and an intake pressure sensor 14 for detecting the pressure in the intake passage of the engine. The sensors 11 to 44 detect the running state of the engine.

The sensors 11 to 14 are connected to an abnormality testing apparatus, which is an electronic control unit (ECU) 100 in this embodiment. The ECU 100 is connected to an MIL 21 and various actuators 22. The actuators include ignition plugs for igniting air-fuel mixture in combustion chambers and injectors for supplying fuel to the combustion chambers. The actuators, or the plug and the injector control the running state of the engine. The ECU 100 always receives clock signals from an oscillator regardless whether the engine is running or not.

Based on clock signals, the ECU 100 detects the running state of the engine based on signals from the sensors 11 to 14 and actuates the actuators 22, accordingly, to control the running state of the engine. Further, according to signals from the sensors 11 to 14, the ECU 100 controls variables that represent the running state of the engine and determines whether there is an abnormality in the engine system based on the variables. When the ECU 100 determines that there is an abnormality of the engine system, which is an abnormality of the thermostat in this embodiment, the ECU 100 lights the MIL 21 to notify the passengers of the abnormality.

The ECU 100 includes a central processing unit (CPU) 110, a read only memory (ROM) 120, a normal random access memory (normal RAM) 130 and a standby random access memory (standby RAM) 140. The ROM 120 stores various programs for controlling the running state of the engine and a program for performing an abnormality test. The normal RAM 130 and the standby RAM 140 store the running state, which is obtained by the CPU 110 based on sensor signals, and the results of computations regarding control procedures and tests for the engine.

The normal RAM 130 has a flag area 131 for storing the values of various flags and a data area 132 for storing data. Information stored in the flag area 131 and the data area 132 is retained only when the ECU 100 is supplied with electricity. When the engine is stopped and current to the ECU 100 is stopped, the information is erased. In other words, information stored in the normal RAM 130 is retained in the current trip and is erased in the subsequent trip.

The standby RAM 140 has a warming-up counter value area 141, a test data area 142, a flag area 143, a data area 144. The warming-up counter value area 141 stores the warming-up counter value when the engine is not running. The test data area 142 stores the results of abnormality test. The flag area 143 stores a flag that is used in abnormality test. The data area 144 stores data such as learned values used in various control procedures of the engine. The standby RAM 140 is always supplied with electricity, for example, from a battery B. Information stored in the areas 141 to 144 is retained even if electricity to the ECU 100 is stopped. In other words, information stored in the standby RAM 140 is retained when the engine is stopped and is carried over to the subsequent trip.

An abnormality testing procedure of the thermostat of the engine system 90 will now be described.

The thermostat is located in a passage that connects the radiator and the coolant passage in the engine and includes a valve that selectively opens and closes the passage based on the coolant temperature. The thermostat adjusts the temperature of the engine to an appropriate level by controlling the opening of the connecting passage with the valve in accordance with the coolant temperature. For example, when the coolant temperature is equal to or lower than eighty degrees centigrade, the thermostat closes its valve to block the connecting passage so that the engine is warmed quickly. When the coolant temperature surpasses eighty degrees centigrade, the thermostat opens its valve so that the engine is cooled, which prevents the engine from being excessively heated.

When there is an abnormality in the valve opening operation of the thermostat, the temperature of the engine is not properly maintained. Particularly, if the valve is stuck to the open position and the passage is held open when the engine is started from a cold state, coolant the heat of which is cooled by the radiator circulates through the engine. Thus, the engine cannot be quickly warmed, which creates friction. Accordingly, the fuel economy is lowered.

In the first embodiment, if the coolant temperature TW is lower than a predetermined value X when the engine is predicted to be sufficiently warmed after being started, the CPU 110 determines that there is an abnormality in the thermostat. When a predicted coolant temperature Tws, which is computed based on the running state of the engine on the supposition that the thermostat is operating normally, reaches a predetermined value Y, the CPU 110 judges that the engine is sufficiently warmed. The value Y is greater than the value X.

The CPU (warming-up counter) 110 computes the predicted coolant temperature Tws and supplies the counter value (the warming-up counter value) that corresponds to the predicted coolant temperature Tws to the standby RAM 140. The warming-up counter value is stored in the warming-up counter value area 141. The predicted coolant temperature Tws is computed based on various parameters that represent the running state of the engine, such as the engine speed detected by the engine speed sensor 13 and the intake pressure detected by the intake air pressure sensor 14. The predicted coolant temperature Tws may be computed by referring to a map that defines the relationship between the coolant temperature and the engine speed or between the coolant temperature and the intake amount. The warming-up counter value is determined by the predicted coolant temperature Tws. Hereinafter, the warming-up counter value represents the predicted coolant temperature Tws.

Figure 2:
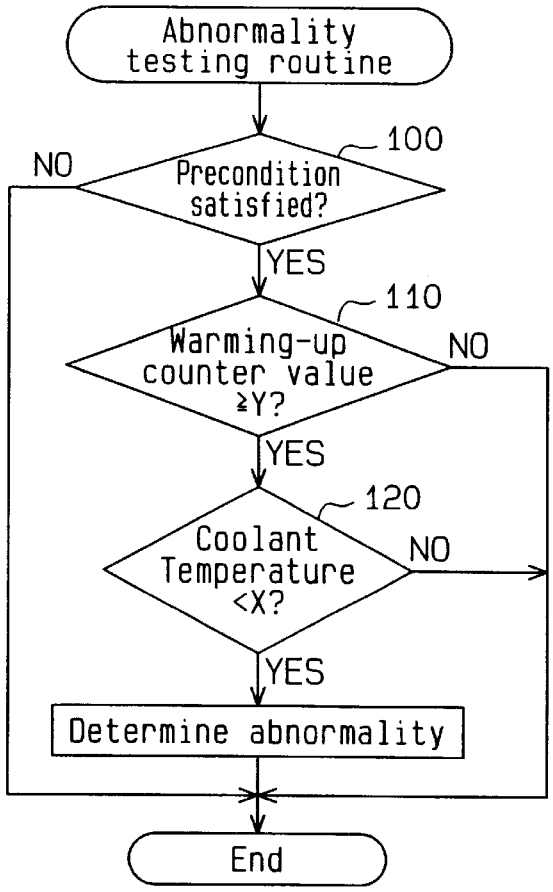
FIG. 2 is a flowchart showing an abnormality testing routine of the apparatus shown in FIG. 1.

The abnormality testing routine of the thermostat will now be described with reference to FIG. 2. The abnormality testing routine is started when a predetermined period has elapsed after the engine is started. The abnormality testing routine is repeated by the CPU 110 (variable manipulating means) at predetermined intervals according to a control program that is stored in the ROM 120.

In step 100, the CPU 110 judges whether a precondition is satisfied. In the first embodiment, the precondition is satisfied when a predetermined period has not elapsed after the engine is started. When sufficient time has elapsed after the engine is started, the thermostat may be erroneously judged to be operating normally even if the thermostat is not operating normally. Step 100 is performed for avoiding such erroneous detections.

If the precondition is satisfied, the CPU 110 proceeds to step 110. In step 110, the CPU 110 judges whether the warming-up counter value (predicted coolant temperature Tws) is equal to or higher than the predetermined value Y. The value Y represents a predetermined coolant temperature. The predetermined coolant temperature, which is represented by the value Y, is lower than and sufficiently close to a valve opening coolant temperature, or the coolant temperature at which the thermostat opens its valve. Therefore, as long as the thermostat is operating normally, the valve is closed from when the engine started to when the warming-up counter value reaches the value Y.

When the warming-up counter value is judged to be equal to or greater than the value Y, the CPU 110 proceeds to step 120. In step 120, the CPU 110 judges whether the detected coolant temperature TW is less than the value X.

Since the value Y is greater than the value X, the predicted coolant temperature Tws is greater than the value X when the warming-up counter value reaches the value Y. Even if the historical data of the running state of the engine is taken into account, the coolant temperature TW has reached the value X in step 120 as long as the thermostat is operating normally.

If the coolant temperature TW is lower than the value X, the CPU 110 proceeds to step 130. In step 130, the CPU 110 determines that there is an abnormality in the thermostat. For example, the valve is stuck to the open position. Step 110, which is based on the warming-up counter value, functions as a process for judging whether a testing condition is satisfied.

The CPU 110 judges whether the testing condition is satisfied based on the warming-up counter value, and performs the abnormality test based also on the warming-up counter value. In other words, the CPU 110 accurately tests an abnormality by taking the historical data of the engine into account.

However, when the engine is stopped while the warming-up counter value is being manipulated, or being incremented, the coolant temperature TW gradually drops. Therefore, when the engine is started again, it is not appropriate to use the warming-up counter value at the time when the engine was stopped. When the engine is restarted, it is also not appropriate to increment the warming-up counter value from the initial state (reset value) when the engine has been stopped only for a short period and the engine is still warm.

To prevent such drawbacks, the CPU 110 stores the warming-up counter value at the time when the engine is stopped in the warming-up counter value area 141 (see FIG. 1) of the standby RAM 140. When the engine is restarted, the warming-up counter value is initialized based on the stored warming-up counter value, the engine stop period TS and the state of the engine when restarted. The engine is considered to have stopped not only when the ignition switch 10 is turned off but also when the engine is temporarily stopped during economy running mode.

In the first embodiment, the warming-up counter is manipulated based on the historical data of the engine. When the engine is started, the warming-up counter value is manipulated in a different manner from when the engine is running normally.

Figure 3:
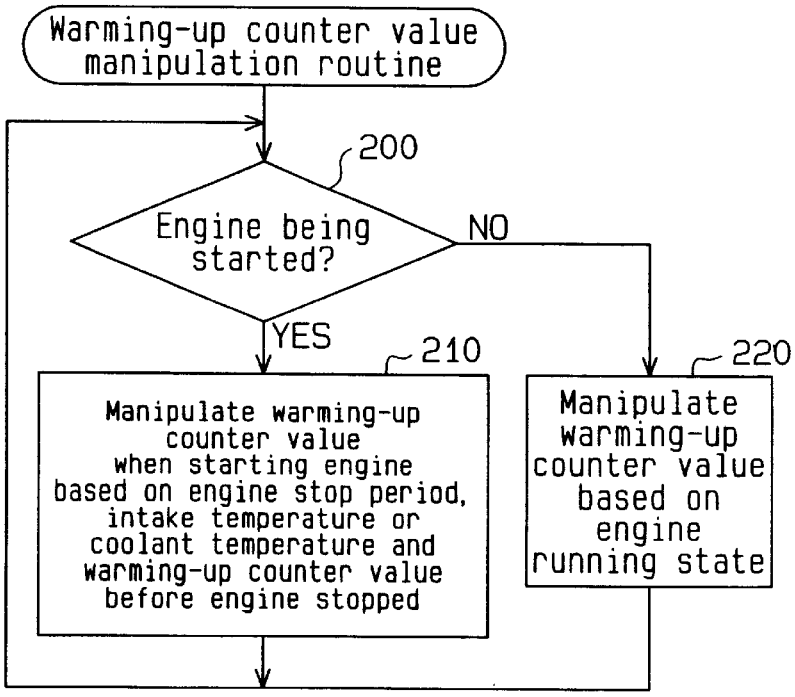
FIG. 3 is a flowchart showing a routine for manipulating a warming-up counter value of the apparatus shown in FIG. 1.

The warming-up counter value manipulation routine will now be described with reference to the flowchart of FIG. 3. The manipulation routine is performed by the CPU 110 according to a control program stored in the ROM 120.

In step 200, the CPU 110 judges whether the engine is currently being started. If the engine is being started, the CPU 110 proceeds to step 210. In step 210, the CPU 110 initializes the warming-up counter value. That is, the CPU 110 sets a new warming-up counter value based on the warming-up counter value when the engine was stopped, the engine stop period TS or the intake temperature, and the coolant temperature when the engine is restarted. In the first embodiment, the CPU 110 functions as the warming-up counter.

If the engine is not being started in step 200, the CPU 110 proceeds to step 220. In step 220, the CPU 110 computes the predicted coolant temperature Tws based on the running state of the engine and manipulates (increments) the warming-up counter value based on the predicted coolant temperature Tws.

Figure 4:
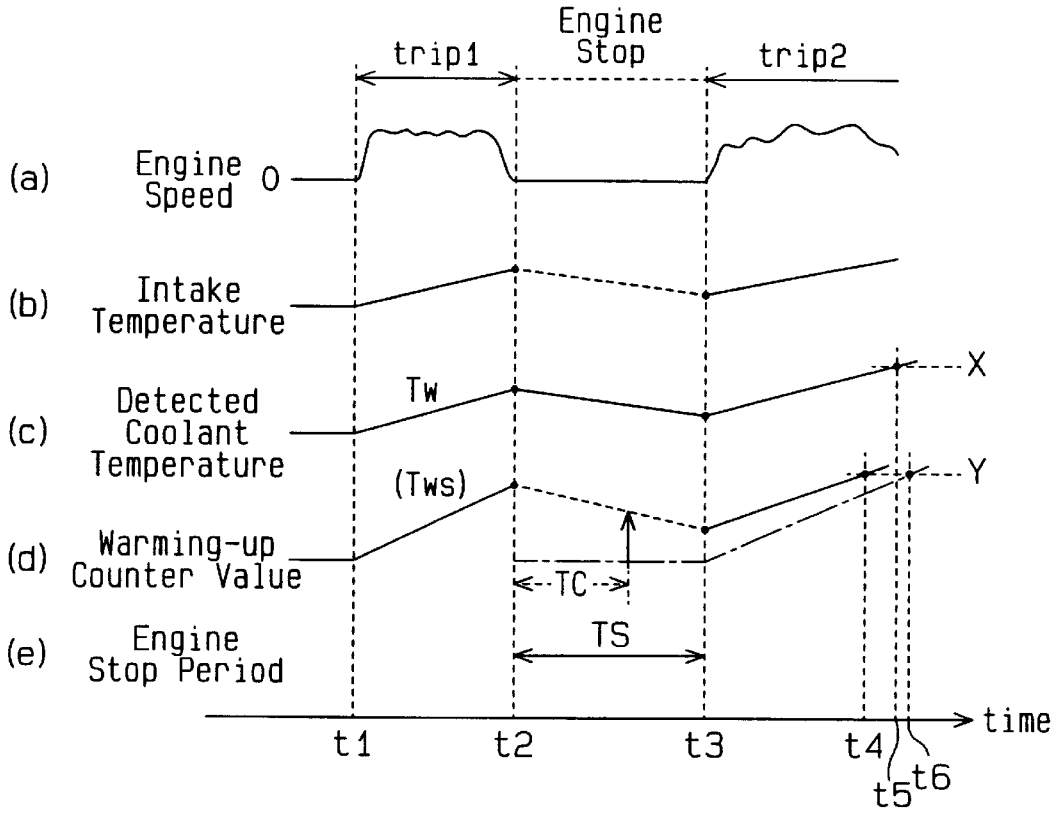
FIGS. 4(*a*) to 4(*e*) are timing charts showing changes of the warming-up counter value of the apparatus shown in FIG. 1 and other parameters.

The timing charts of FIGS. 4(*a*) to 4(*e*) show changes of various values such as the warming-up counter value. At time t1, the engine is started, or a trip 1 is started. Then, the engine speed increases and is stabilized at a certain level (see FIG. 4(*a*)). Accordingly, the intake air temperature and the detected coolant temperature TW are increased (see FIGS. 4(*b*) and 4(*c*)). The warming-up counter value is manipulated, or incremented (FIG. 4(*d*)), in accordance with the predicted coolant temperature Tws, which is computed based on the running state, or the speed and the intake pressure, of the engine. FIG. 4(*c*) shows changes of the detected coolant temperature TW when the thermostat is not operating normally and its valve is stuck to the open position.

At time t2, the engine is temporarily stopped and the trip 1 is finished. Then, the intake temperature and the coolant temperature TW start dropping. When the engine stop period TS has elapsed (time t3), the engine is started again. The CPU 110 computes the predicted coolant temperature Tws at time t3 based on the intake temperature or the coolant temperature at time t3, the warming-up counter value that was stored in the standby RAM 140 at time t2 and the engine stop period TS (FIG. 4(*e*)) measured by the clock. The CPU 110 sets the warming-up counter value to correspond to the predicted coolant temperature Tws.

When the engine is started again, the warming-up counter value is initialized by taking the historical data of the state of the engine while the engine is not running (engine stop time TS). Therefore, the warming-up counter value (the predicted coolant temperature Tws) quickly reaches the value Y, which satisfies the test condition. If the detected coolant temperature TW has not reached the value X at time t4, the CPU 110 determines that there is an abnormality in the thermostat.

If the warming counter value is reset when engine is started again at time t3, the warming up counter changes as shown by dashed line in FIG. 4(*d*). That is, the warming-up counter value reaches the value Y at time t6, which is later than time t4. Thus, even if the thermostat is malfunctioning and the coolant temperature is not smoothly increased, the detected coolant temperature TW reaches the value X at time t5, which is earlier than time t6. Therefore, in step 120 of FIG. 2, an abnormality of the thermostat is not determined.

The abnormality determining apparatus 100 according to the first embodiment has the following advantages.

(1) When the engine started after being temporarily stopped, the CPU 110 computes the predicted coolant temperature Tws based on the detected intake air temperature, the coolant temperature TW, the warming-up counter value stored in the standby RAM 140 and the engine stop period TS. The warming-up counter in the warming-up counter is initialized to correspond to the predicted coolant temperature Tws. Therefore, accurate abnormality test can be performed at an early stage after the engine is restarted. Further, when the engine is not running, the warming-up counter need not be manipulated, which prevents unnecessary consumption of electricity of the battery B.

(2) Since the warming-up counter value is determined when the engine is restarted, the predicted coolant temperature Tws is computed by a simple procedure.

An abnormality determining apparatus according to a second embodiment of the present invention will now be described. Mainly, the differences from the first embodiment will be discussed below.

In the first embodiment, the warming-up counter value at the time when the engine is stopped is stored in the standby RAM 140. When the engine is restarted, the stored warming-up counter value is adjusted according to the historical date of the state of the engine while the engine is not running.

In the second embodiment, the warming-up counter value is decremented based on the elapsed time TC during which the engine is not running. Specifically, the following processes are executed in the second embodiment.

(a) The abnormality determining apparatus (ECU) 100 is supplied with current not only when the engine is not running during an economy running but also when the ignition switch 10 is turned off.

(b) The elapsed time TC is obtained by using the clock. The ECU 100 continuously computes the predicted coolant temperature based on the elapsed time TC.

(c) The ECU 100 continuously manipulates (decrements) the warming-up counter value in accordance with the predicted coolant temperature.

In the second embodiment, the warming-up counter value is always manipulated during economy running mode and when the ignition switch 10 is turned off.

Figure 5:
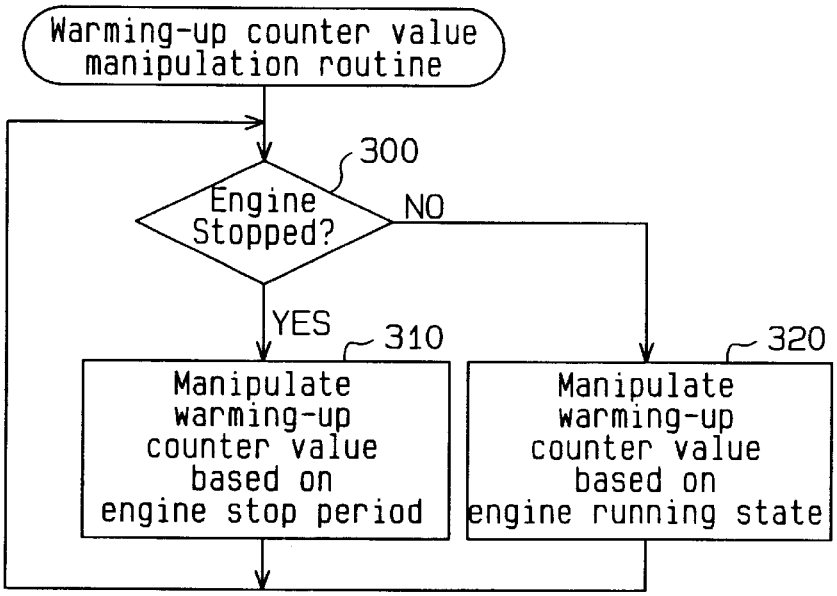
FIG. 5 is a flowchart showing a routine for manipulating a warming-up counter value of an abnormality testing apparatus of an engine according to a second embodiment of the present invention.

The warming-up counter value manipulation routine of the second embodiment will now be described with reference to the flowchart of FIG. 5. The routine of FIG. 5 is executed by the CPU 110 according to a control program stored in the ROM 120.

In step 300, the CPU 110 judges whether the engine is stopped. If the engine is stopped, the CPU 110 proceeds to step 310. In step 310, the CPU 110 decrements the warming-up counter value based on the elapsed time TC after the engine is stopped.

If the engine is running, the CPU 110 proceeds to step 320. In step 320, the CPU 110 computes the predicted coolant temperature Tws based on the running state of the engine, and manipulates (increments) the warming-up counter value in accordance with the predicted coolant temperature Tws.

The abnormality determining apparatus 100 according to the second embodiment has the following advantage.

Since the warming-up counter value is continuously manipulated (decremented) while the engine is not running, the warming-up counter value is reliable. Therefore, when the engine is started and stopped frequently in a short period, an abnormality of the thermostat is detected at an early stage. Also, whether the test condition is satisfied is determined at an early stage.

It should be apparent to those skilled in the art that the present invention may be embodied in many other specific forms without departing from the spirit or scope of the invention. Particularly, it should be understood that the invention may be embodied in the following forms.

In the first embodiment, the predicted coolant temperature Tws may be computed when the engine is restarted without using the intake temperature and the coolant temperature TW at the time of restarting of the engine.

Instead of the intake temperature and the coolant temperature TW, other parameters that represent the running state of the running environment of the engine at the time of restart may be used. In this case, the warming-up counter value at the time of engine restart is initialized based on the warming-up counter at the time of stopping, the stop period TS and at least one of parameters that represent the running state and the running environment at the time of restart.

When the engine is restarted in the first embodiment, the warming-up counter value may be initialized based not only on the warming-up counter value when the engine was stopped and the stop period TS, but also on at least one of parameters such as the running state and the running environment when or before the engine was stopped.

In the first embodiment, the engine stop period TS may be estimated based on parameters that represent the running state of the engine such as the coolant temperature and the intake temperature, from the previous trip of the engine and parameters representing the running state of the engine, such as the coolant temperature and the intake temperature when the engine is restarted.

In the second embodiment, the predicted coolant temperature Tws at the time of engine stop may be computed by taking at least one of the running state of the engine and the running environment of the engine before the engine is stopped into account. In other words, the warming-up counter value may be manipulated by taking the at least one of the running state of the engine and the running environment of the engine before the engine is stopped into account.

In the second embodiment, a parameter that represents the state of the engine or the external environment of the engine may be continuously detected when the engine is not running, and the detected value may be used for computing the predicted coolant temperature at the time of engine stop.

The warming-up counter value may be manipulated based on the external environment such as the external temperature, which can be directly detected, and on the temperature of the engine.

The warming-up may be a device that is separated from and is controlled by the CPU 110.

The present invention may be applied to an abnormality testing apparatus that uses a warming-up counter for permitting a normality determination. In this case, the warming-up counter value is computed based on the running state of the engine on supposition that the thermostat is operating normally. When computing the warming-up counter value, for example, the historical data while the engine is not running is taken into account. That is, when a certain period of time has elapsed from when the engine is started from a cold state and the coolant temperature has reached a predetermined value, the thermostat may be functioning normally. However, even if there is an abnormality in the thermostat, that is, for example, even if the valve of the thermostat is stuck to the open position, the coolant temperature may reach the predetermined value depending on the running state of the engine. In this case, the thermostat is determined to be functioning normally if the warming-up counter is lower than the predetermined value and the coolant temperature does not reach the predetermined value due to the valve being stuck to the open position.

The present invention may be applied to an abnormality testing apparatus that performs a test for a coolant temperature sensor only when the engine is started from a cold state. Further, the present invention may be applied to an abnormality testing apparatus for a fuel vapor purge system or to a catalyst deterioration detection apparatus. In these cases, the warming-up counter value is manipulated in accordance with a variant that is computed or detected for indicating the state such as the temperature of a specific part of the engine.

The present invention may be applied to an apparatus that detects whether catalyst is deteriorated only when the engine is warmed.

The illustrated embodiments are used for judging whether a test condition is satisfied. However, the present invention may be applied to any type of abnormality testing apparatus that uses the warming-up counter. For example, the present invention may be applied to an apparatus that performs abnormality test of temperature sensors.

In the first and second embodiments, the manipulated variable is not limited to the warming-up counter value. For example, the manipulated variable may be any value indicating the state of a specific part of an engine system that changes its state according to the running state of the engine and the external environment. The present invention may be applied to a testing apparatus that has means for manipulating such a variable and performs an abnormality test or determines whether the test condition is satisfied based on the manipulated variable.

Therefore, the present examples and embodiments are to be considered as illustrative and not restrictive and the invention is not to be limited to the details given herein, but may be modified within the scope and equivalence of the appended claims.

What is claimed is:

1. An apparatus for testing an abnormality of an engine system, comprising:

means for manipulating a variable, wherein the variable manipulating means computes a variable that relates to the engine system based on the state of an engine and manipulates the variable in accordance with the state of the engine, and wherein the apparatus performs at least one of the abnormality test and judgment whether a test condition is satisfied according to the variable;

wherein the variable manipulating means manipulates the variable in the state of the engine, wherein the state is a state in which the engine is not running.

2. The apparatus according to claim 1, further comprising a sensor, which is connected to the variable manipulating means and detects a parameter that represents the state of the engine, wherein the variable manipulating means manipulates the variable according to the detected parameter, and wherein the sensor continues detecting the parameter while the engine is not running.

3. The apparatus according to claim 1, further comprising a sensor, which is connected to the variable manipulating means and detects a parameter that represents the state of the engine, wherein the variable manipulating means manipulates the variable according to the detected parameter, and wherein, when the engine is not running, the variable manipulating means manipulates the variable based on the value of the variable that was manipulated when the engine was stopped immediately before and on a period that has elapsed since the engine was stopped.

4. The apparatus according to claim 3, wherein, when the engine is not running, the variable manipulating means manipulates the variable further based on at least one of the state of the engine before the engine was stopped and the running environment of the engine before the engine was stopped.

5. The apparatus according to claim 2, wherein the variable manipulating means includes a warming-up counter, which is manipulated in accordance with the warming up state of the engine, and wherein the variable is the counter value of the warming-up counter.

6. An apparatus for testing an abnormality of an engine system, comprising:

means for manipulating a variable, wherein the variable manipulating means computes a variable that relates to the engine system based on the state of an engine and manipulates the variable in accordance with the state of the engine, and wherein the apparatus performs at least one of the abnormality test and judgment whether a test condition is satisfied according to the variable;

wherein, when the engine is started, the variable manipulating means manipulates the variable based on the value of the variable that was manipulated when the engine was stopped immediately before and on historical data that represents the state of the engine, wherein the state is a state in which the engine is not running.

7. The apparatus according to claim 6, further comprising a sensor, which is connected to the variable manipulating means and detects a parameter that represents the state of the engine, wherein the variable manipulating means manipulates the variable according to the detected parameter, and wherein, when the engine is started, the variable manipulating means manipulates the variable based on the value of the variable that was manipulated when the engine was stopped immediately before and on a period in which the engine is not running.

8. The apparatus according to claim 7, wherein, when the engine is started, the variable manipulating means manipulates the variable further based on at least one of the state of the engine when the engine is started and the running environment of the engine when the engine is started.

9. The apparatus according to claim 7, wherein, when the engine is started, the variable manipulating means manipulates the variable further based on at least one of the state of the engine when the engine was stopped immediately before and the running environment of the engine when the engine was stopped immediately before.

10. The apparatus according to claim 7, wherein the variable manipulating means predicts the period in which the engine is not running based on the state of the engine when the engine was stopped and on the state of the engine when the engine is started.

11. The apparatus according to claim 7, wherein the variable manipulating means includes a warming-up counter, which is manipulated in accordance with the warming up state of the engine, and wherein the variable is the counter value of the warming-up counter.

12. A method for testing an abnormality of an engine system, comprising:

computing a variable that relates to the engine system based on the state of an engine;

manipulating the variable in accordance with the state of the engine, wherein the state is a state in which the engine is not running; and performing at least one of the abnormality test and judgement whether a test condition is satisfied according to the variable.

13. The method according to claim 12, wherein the computing step includes detecting the state of the engine with a sensor, wherein the detection of the sensor is continued when the engine is not running, and wherein the manipulating step includes manipulating the variable in accordance with a detection value of the sensor.

14. The method according to claim 12, wherein the computing step includes detecting the state of the engine with an appropriate sensor, and wherein the manipulating step includes:

manipulating the variable in accordance with a detection value of the sensor; and manipulating the variable when the engine is not running based on the value of the variable that was manipulated when the engine was stopped immediately before and on a period that has elapsed since the engine was stopped.

15. The method according to claim 14, wherein the manipulating step includes manipulating the variable when the engine is not running further based on at least one of the state of the engine before the engine was stopped and the running environment of the engine before the engine was stopped.

16. The apparatus according to claim 12, wherein the manipulating step includes manipulating a warming-up counter value, which represents the warming up state of the engine, as the variable.

17. A method for testing an abnormality of an engine system, comprising:

computing a variable that relates to the engine system based on the state of an engine;

manipulating the variable when the engine is started based on the value of the variable that was manipulated when the engine was stopped immediately before and on historical data that represents the state of the engine, wherein the state is a state in which the engine is not running; and performing at least one of the abnormality test and judgment whether a test condition is satisfied according to the variable.

18. The method according to claim 17, wherein the computing step includes detecting the state of the engine with a sensor, and wherein the manipulating step includes:

manipulating the variable in accordance with a detection value of the sensor; and manipulating the variable when the engine is started based on the value of the variable that was manipulated when the engine was stopped immediately before and on a period in which the engine is not running.

19. The method according to claim 18, wherein the manipulating step includes manipulating the variable when the engine is started further based on at least one of the state of the engine when the engine is started and the running environment of the engine when the engine is started.

20. The method according to claim 18, wherein the manipulating step includes manipulating the variable when the engine is started further based on at least one of the state of the engine when the engine was stopped immediately before and the running environment of the engine when the engine was stopped immediately before.

21. The method according to claim 18, wherein the manipulating step includes predicting the period in which the engine is not running based on the state of the engine when the engine was stopped immediately before and on the state of the engine when the engine is started.

22. The method according to claim 17, wherein the manipulating step includes manipulating a warming-up counter value, which represents the warming up state of the engine, as the variable.

* * * * *